US008368716B2

(12) United States Patent
Moroney

(10) Patent No.: US 8,368,716 B2
(45) Date of Patent: Feb. 5, 2013

(54) PROCESSING PIXEL VALUES OF A COLOR IMAGE

(75) Inventor: Nathan Moroney, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1135 days.

(21) Appl. No.: 12/240,958

(22) Filed: Sep. 29, 2008

(65) Prior Publication Data

US 2010/0079502 A1 Apr. 1, 2010

(51) Int. Cl.
*G09G 5/02* (2006.01)

(52) U.S. Cl. ..... 345/604; 345/690

(58) Field of Classification Search ..... 345/418, 345/581, 589, 590, 591, 592, 593, 595, 596, 345/597, 598, 599, 604, 690; 382/162, 164, 382/165, 167

See application file for complete search history.

(56) References Cited

U.S. PATENT DOCUMENTS

| | | | | | |
|---|---|---|---|---|---|
| 5,432,893 | A * | 7/1995 | Blasubramanian et al. | .. | 345/600 |
| 5,870,077 | A * | 2/1999 | Dillinger et al. | ..... | 345/600 |
| 6,014,457 | A * | 1/2000 | Kubo et al. | ..... | 382/167 |
| 6,028,961 | A * | 2/2000 | Shimomura | ..... | 382/239 |
| 6,310,969 | B1 * | 10/2001 | Kim et al. | ..... | 382/162 |
| 6,535,301 | B1 * | 3/2003 | Kuwata et al. | ..... | 358/1.9 |
| 6,933,949 | B1 * | 8/2005 | McDonough et al. | ..... | 345/591 |
| 7,366,350 | B2 * | 4/2008 | Kajihara | ..... | 382/167 |
| 7,945,092 | B2 * | 5/2011 | Hayashi et al. | ..... | 382/167 |
| 2004/0156544 | A1 * | 8/2004 | Kajihara | ..... | 382/167 |
| 2008/0193011 | A1 * | 8/2008 | Hayashi et al. | ..... | 382/167 |

* cited by examiner

*Primary Examiner* — Dorothy Harris

(57) ABSTRACT

In a method for processing pixel values of an image in a first representation to a second representation having a yellow-blue axis, a red-green axis, and a luminance axis, the pixel values are converted from the first representation to the second representation by converting the pixel values to a more opponent color encoding using a logical operator to compute a yellowness-blueness value of each of the pixel values and using scaled multiplications to compute a redness-greenness value of each of the pixel values in the second representation. In addition, the converted pixel values are outputted.

17 Claims, 7 Drawing Sheets

PROCESSING PIXEL VALUES OF A COLOR IMAGE

BACKGROUND

A color digital image is typically displayed or printed in the form of a rectangular array of pixels. A color digital image may be represented in a computer by three arrays of binary numbers. Each array represents an axis of a suitable color coordinate system. The color of a pixel in the digital image is defined by an associated binary number, which defines one of three color components from the color coordinate system, from each array. There are many color coordinate systems that are often used to represent the color of a pixel. These color coordinate systems include a "Red-Green-Blue" (RGB) coordinate system and a cyan-magenta-yellow (CMY) coordinate system. The RGB coordinate system is commonly used in monitor display applications and the CMY coordinate system is commonly used in printing applications.

The amount of data used to represent a digital image is extremely large, which often results in significant costs that are associated both with increased storage capacity requirements, and the computing resources and time required to transmit the data to another computing device. Efforts to reduce these costs through digital image compression techniques, such as, color quantization, have been developed. Color quantization of an image is a process in which the bit-depth of a source color image is reduced. Extreme color quantization is a process in which the bit-depth of a source color image is severely reduced, such as, from millions of colors to dozens of colors.

Extreme color quantization has also been used for region segmentation and non-photographic rendering, where a significantly reduced bit-depth is desirable. For instance, extreme color quantization has been used to combine multiple sets of colors into single colors. One application of extreme color quantization is to render a photographic color digital image to have a "cartoon-like" appearance.

There are two main challenges to implementing extreme color quantization. The first challenge involves identifying the locations of the nodes to which the colors are mapped in a representation. The second challenge involves identifying the shapes of the boundaries that define the range of input colors to be mapped to the respective single output colors. Ideally, the nodes and their boundaries are consistent with those nodes and boundaries that are likely to be used by a human observer. By way of example, a node may be a location for a "gray" color and the boundary of that node may be all of the colors that are "grayish".

However, conventional color quantization, particularly extreme color quantization, processes are unable to meet or come close to the ideal conditions. For instance, the resulting nodes of the quantization often fall relatively far away from the colors or hues that a human observer would likely select as being optimal. In addition, the resulting uniform boundaries for the different color regions do not accurately follow their corresponding nodes.

An example of a representation resulting from application of a conventional extreme quantization process on a color digital image is depicted in the diagram 100 shown in FIG. 1. The diagram 100, more particularly, depicts the nodes 102-108 resulting from a conventional extreme quantization process. In addition, the x-axis or a* axis denotes the redness-greenness, the y-axis or b* axis denotes the yellowness-blueness, and the z-axis denotes the lightness axis, which goes through an origin of the diagram 100, of the colors processed in the CIELAB color space.

In FIG. 1, the node 102 denotes the location of the color that is close to pure or ideal green, the node 104 denotes the location of the color that is close to pure or ideal yellow, the node 106 denotes the location of the color that is close to pure or ideal red, and the node 108 denotes the location of the color that is close to pure or ideal blue. As shown in FIG. 1, the nodes 102-108 are relatively far from the negative a* axis 126, the positive b* axis 124, the positive a* axis, and the negative b* axis, respectively. The diagram 100 thus illustrates that the resulting locations of the colors, as denoted by the nodes 102-106, are relatively far from the colors that a human observer would likely select as being ideal.

Another example of a representation resulting from application of a conventional extreme quantization process on a color digital image is depicted in the diagram 200 of FIG. 2. Similarly to FIG. 1, the diagram 200 depicts the nodes 102-108 resulting from a conventional extreme quantization process. In addition, the same data plotted in FIG. 1 has been plotted in FIG. 2, which denotes a conventional YCC color space. As such, the x-axis or $C_2$ axis denotes the redness-greenness, the y-axis or $C_1$ axis denotes the yellowness-blueness, and the z-axis denotes the luminance axis, which goes through an origin of the diagram 200, of the colors processed in a conventional YCC color space.

As in FIG. 1, the node 102 denotes the location of the color that is close to pure or ideal green, the node 104 denotes the location of the color that is close to pure or ideal yellow, the node 106 denotes the location of the color that is close to pure or ideal red, and the node 108 denotes the location of the color that is close to pure or ideal blue. Again, the nodes 102-108 are illustrated as being relatively far from the negative $c_1$ axis 130, the positive $c_2$ axis 132, the positive $c_1$ axis, and the negative $c_2$ axis, respectively. The diagram 200 thus illustrates that the resulting locations of the colors, as denoted by the nodes 102-106, are relatively far from the colors that a human observer would likely select as being ideal.

Although not shown in FIGS. 1 and 2, uniform boundaries for the different regions in the diagrams 100 and 200 do not accurately follow their corresponding nodes 102-108 because, as denoted by the lines 112-118 connecting the nodes 102-108 to a center of the diagrams 100 and 200, opposing lines are not orthogonal with respect to each other.

It would therefore be desirable to have a process for extreme color quantization that does not suffer from the drawbacks and disadvantages of convention color quantization techniques.

BRIEF DESCRIPTION OF THE DRAWINGS

Features of the present invention will become apparent to those skilled in the art from the following description with reference to the figures, in which.

DETAILED DESCRIPTION

For simplicity and illustrative purposes, the present invention is described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structures have not been described in detail so as not to unnecessarily obscure the present invention.

Disclosed herein are a system and method for processing pixel values of a color image, in which the pixel values are converted from a first representation to a second representation. The second representation includes a yellow-blue axis, a red-green axis, and a luminance axis. In addition, during the conversion, the pixel values are converted to a more opponent color encoding using a logical operator to compute a yellowness-blueness value of each of the pixel values and using scaled multiplications to compute a redness-greenness value of each of the pixel values in the second representation.

Through implementation of the system and method disclosed herein, the nodes of a representation denoting the locations of the colors of the pixel values are caused to be relatively close to the colors that a human observer would likely select as being ideal. The system and method disclosed herein also enables the color boundaries to more closely track the boundaries of the nodes as compared with conventional color processing systems and methods. As described in greater detail herein below, the processing system and method disclosed herein are relatively simple and efficient to implement and may thus be extended to a relatively large number of colors.

Figure 3:
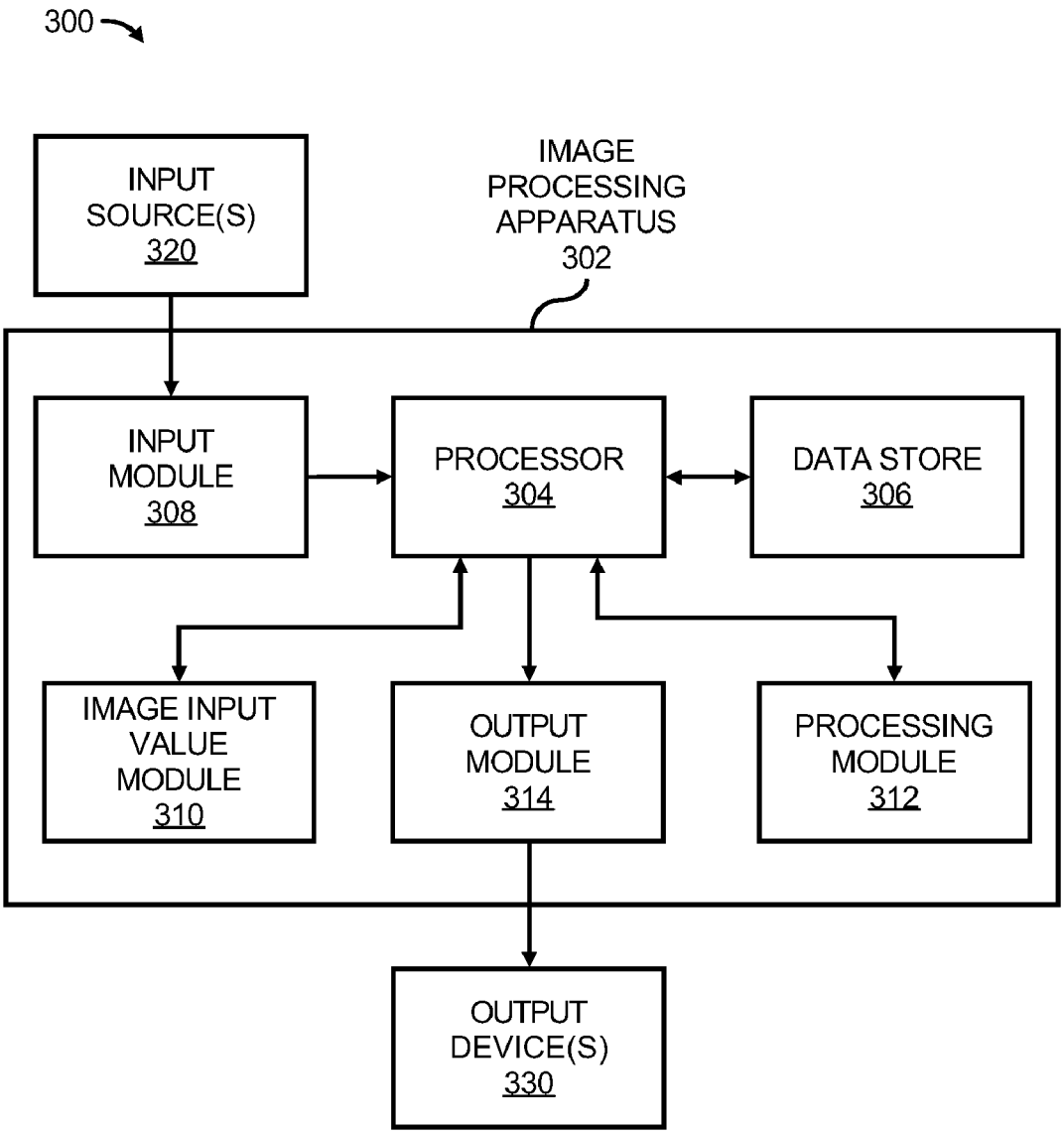
FIG. 3 shows a simplified block diagram of a system for processing colors in an image, according to an embodiment of the invention.

With reference now to FIG. 3, there is shown a simplified block diagram of a system 300 for processing colors in an image, according to an example. It should be understood that the system 300 may include additional elements and that some of the elements described herein may be removed and/or modified without departing from a scope of the system 300.

As shown, the system 300 includes an image processing apparatus 302, which may comprise any reasonably suitable apparatus for processing color images. The image processing apparatus 302 may comprise, for instance, a camera, a scanner, a computing device, an imaging device, a memory for holding an element, elements in a memory, etc. In one regard, the image processing apparatus 302 may implement various features of the image processing techniques disclosed herein.

The system 300 is also depicted as including one or more input sources 320 and one or more output devices 330. The input source(s) 320 may comprise, for instance, an image capture device, such as, a scanner, a camera, etc., an external memory, a computing device, etc. The input source(s) 320 may also be integrated with the image processing apparatus 302. For instance, where the image processing apparatus 302 comprises a digital camera, the input source 320 may comprise the lenses through which images are captured.

The output device(s) 330 may comprise, for instance, a display device, a removable memory, a printer, a computing device, etc. The output device(s) 330 may also be integrated with the image processing apparatus 302. In the example where the image processing apparatus 302 comprises a digital camera, the output device 330 may comprise a display of the digital camera.

The image processing apparatus 302 is depicted as including a processor 304, a data store 306, an input module 308, an image input value module 310, a processing module 312, and an output module 314. The processor 304 may comprise any reasonably suitable processor conventionally employed in any of the image processing apparatuses discussed above. The data store 306 may comprise volatile and/or non-volatile memory, such as DRAM, EEPROM, MRAM, flash memory, and the like. In addition, or alternatively, the data store 306 may comprise a device configured to read from and write to a removable media, such as, a floppy disk, a CD-ROM, a DVD-ROM, or other optical or magnetic media.

Each of the modules 308-314 may comprise software, firmware, or hardware configured to perform various functions in the image processing apparatus 302. Thus, for instance, one of the modules 308-314 may comprise software while another one of the modules 308-314 comprises hardware, such as, a circuit component. In instances where one or more of the modules 308-314 comprise software, the modules 308-314 may be stored on a computer readable storage medium, such as, the data store 306, and may be executed by the processor 304. In instances where one or more of the modules 308-314 comprise firmware or hardware, the one or more modules 308-314 may comprise circuits or other apparatuses configured to be implemented by the processor 304.

The input module 304 is configured to receive input, such as, input images, from the input source(s) 320. In addition, the processor 304 may store the input images in the data store 306. The processor 304 may also implement or execute the image input value module 310 to identify the pixel values of the input images to be processed.

The processor 304 may also implement or execute the processing module 312 to process the identified pixel values of a selected image. More particularly, the processor 304 may implement or execute the processing module 312 to process the pixel values of the selected image from a first representation to a second representation. The first representation may comprise, for instance, an RGB color space, a CMY color space, etc. The second representation includes a yellow-blue axis, a red-green axis, and a luminance axis, similar to a conventional YCC color space. The second representation differs from conventional YCC color spaces because in the second representation, the pixel values are converted to a more opponent color encoding (as compared with conventional YCC color spaces) using a logical operator to compute the yellowness-blueness of the pixel values and scaled multiplications to compute the redness-greenness of the pixel values in the second representation.

According to another example, the image processing apparatus 302 may comprise the processing module 312 itself. In this example, the image processing apparatus 302 may comprise a circuit designed and configured to perform all of the functions of the processing module 312. In addition, the image processing apparatus 302 may comprise an add-on device or a plug-in that may be implemented by a processor of a separate image processing apparatus.

The processor 304 is configured to implement or execute the output module 314 to output the processed pixel values to the output device(s) 330. The processed pixel values may thus be stored in a data storage medium, displayed on a display, delivered to a computing device, a combination thereof, etc.

Figure 4:
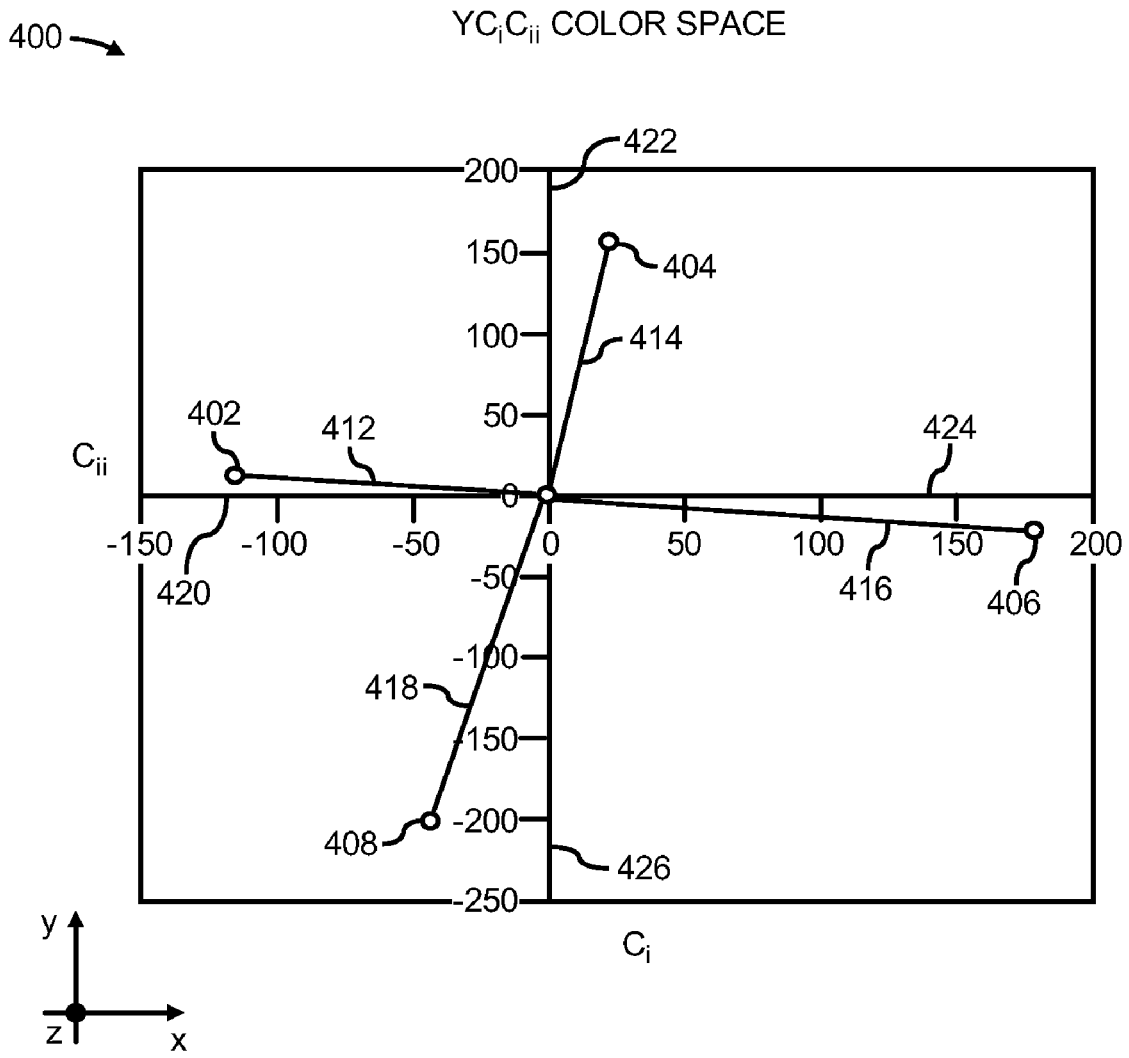
FIG. 4 illustrates a diagram of a representation resulting from application of the system for processing colors depicted in FIG. 3 and the flow diagrams of the methods depicted in FIGS. 5 and 6, according to an embodiment of the invention.

An example of a representation resulting from implementation or execution of the processing module 312 is depicted in the diagram 400 of FIG. 4. FIG. 4, more particularly, depicts the nodes 402-408 from the same data plotted in FIGS. 1 and 2 in a modified YCC color space ($YC_iC_{ii}$) representation. The node 402 denotes the location of the color that is close to pure or ideal green, the node 404 denotes the location of the color that is close to pure or ideal yellow, the node 406 denotes the location of the color that is close to pure or ideal red, and the node 408 denotes the location of the color that is close to pure or ideal blue. The x-axis or the $C_i$ axis denotes the redness-greenness, the y-axis or the $C_{ii}$ axis denotes the yellowness-blueness, and the z-axis denotes the luminance axis, which goes through an origin of the diagram 400. Also shown in FIG. 4 are a negative $C_i$ axis 426, a positive $C_{ii}$ axis 424, a positive $C_i$ axis 422, and a negative $C_{ii}$ axis 420.

Figure 1:
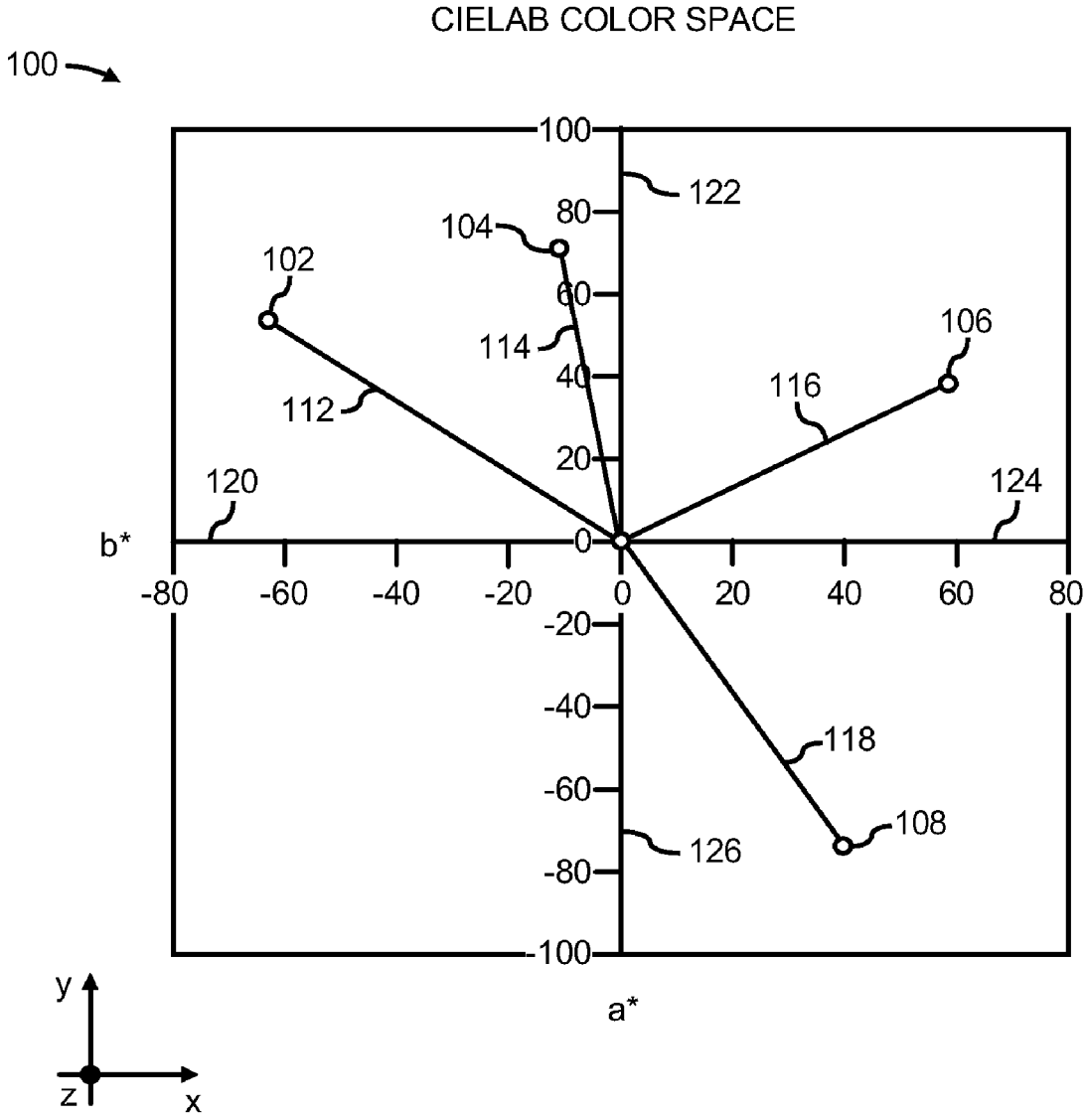
FIG. 1 (Prior Art)
FIG. 1 shows a diagram of a representation resulting from application of a conventional extreme quantization process on a color digital image.
Figure 2:
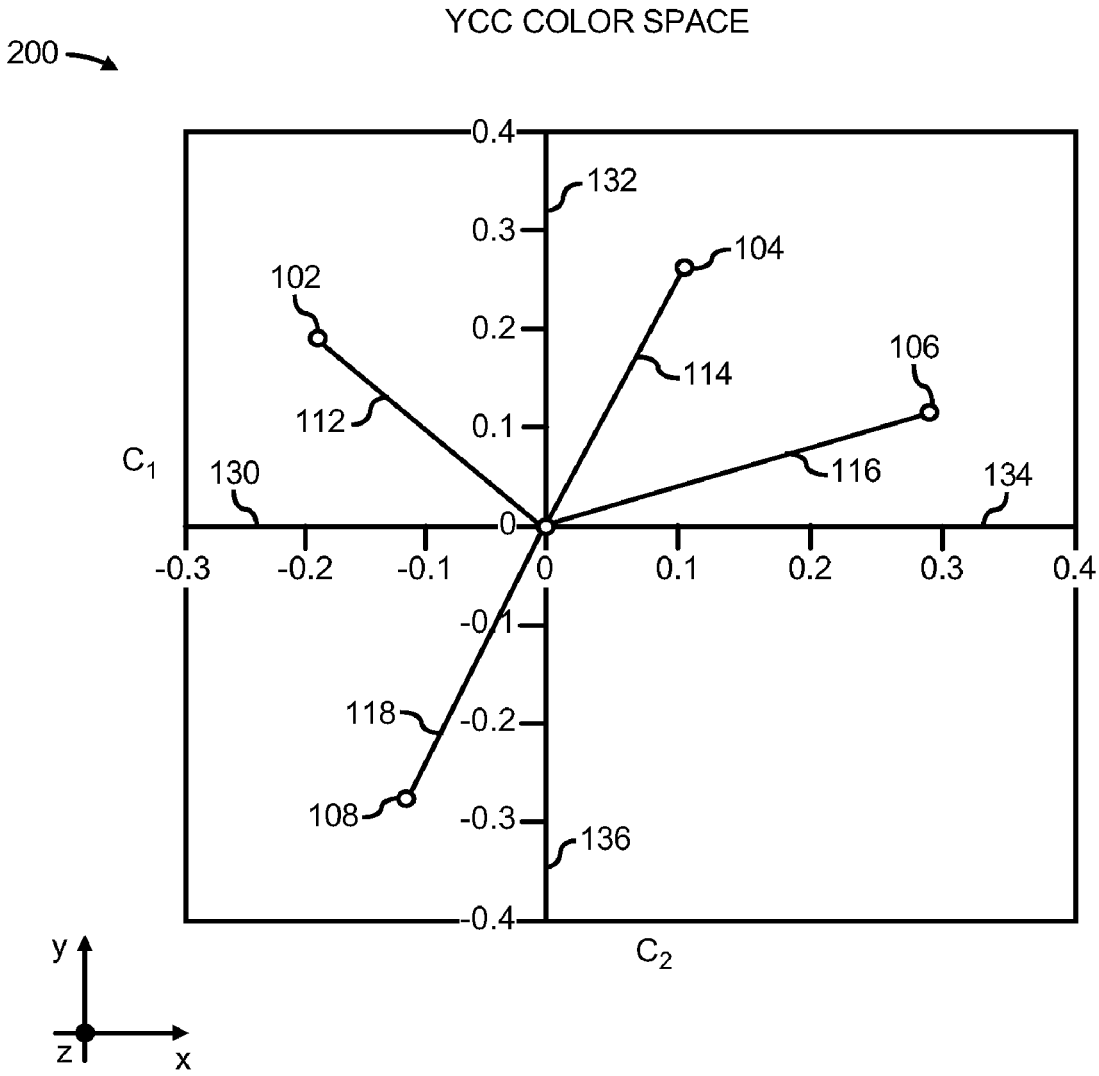
FIG. 2 (Prior Art)
FIG. 2 shows a diagram of a representation resulting from application of another conventional extreme quantization process on a color digital image.

As shown in the diagram 400, the nodes 402-408 are located much closer to the colors that a human observer would likely select as being optimal as compared with the representations depicted in FIGS. 1 and 2. In addition, uniform boundaries for the different regions in the diagram 400 more accurately follow their corresponding nodes 402-408 because, as denoted by the lines 412-418 connecting the nodes 402-408 to the origin of the diagram 400, opposing lines 412-418 are more orthogonal with respect to each other as compared with the representations depicted in FIGS. 1 and 2.

A more detailed description of various manners in which the processing module 314 processes the selected image will now be described with respect to the following flow diagrams of the methods 500 and 600 respectively depicted in FIGS. 5 and 6. It should be apparent to those of ordinary skill in the art that the methods 500 and 600 represent generalized illustrations and that other steps may be added or existing steps may be removed, modified or rearranged without departing from the scopes of the methods 500 and 600.

The descriptions of the methods 500 and 600 are made with reference to the system 300 illustrated in FIG. 3, and thus makes reference to the elements cited therein. It should, however, be understood that the methods 500 and 600 are not limited to the elements set forth in the system 300. Instead, it should be understood that the methods 500 and 600 may be practiced by a system having a different configuration than that set forth in the system 300.

Some or all of the operations set forth in the methods 500 and 600 may be contained as utilities, programs, or subprograms, in any desired computer accessible medium. In addition, the methods 500 and 600 may be embodied by computer programs, which can exist in a variety of forms both active and inactive. For example, they may exist as software program(s) comprised of program instructions in source code, object code, executable code or other formats. Any of the above may be embodied on a computer readable medium, which include storage devices and signals, in compressed or uncompressed form.

Exemplary computer readable storage devices include conventional computer system RAM, ROM, EPROM, EEPROM, and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. It is therefore to be understood that any electronic device capable of executing the above-described functions may perform those functions enumerated above.

A processor, such as the processor 304, may implement or execute the processing module 312 to perform some or all of the steps identified in the methods 500 and 600 in processing colors in an image having a plurality of pixel values.

Figure 5:
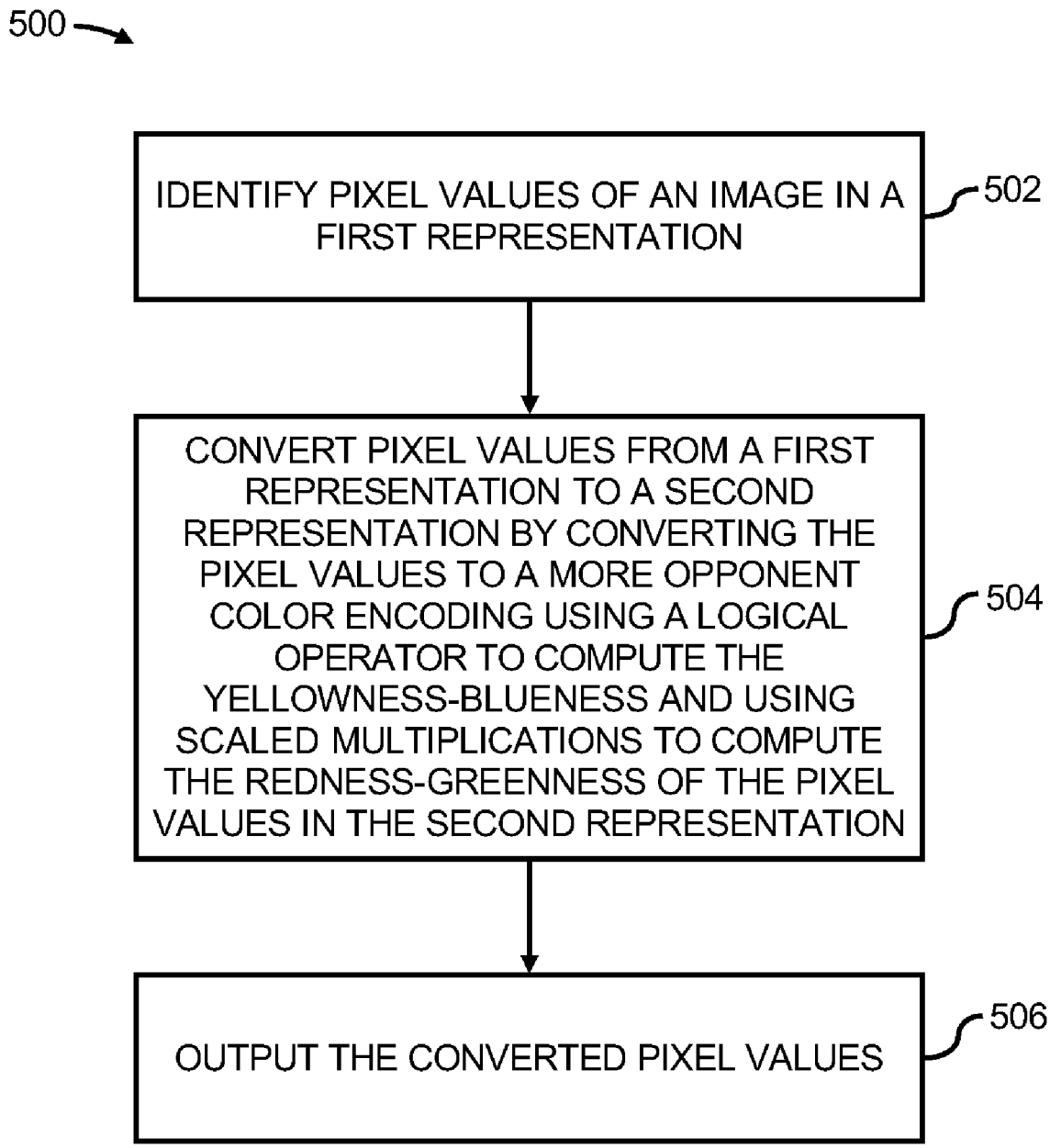
FIG. 5 shows a flow diagram of a method for processing colors in an image having a plurality of pixel values in a first representation, according to an embodiment of the invention.

With reference first to FIG. 5, there is shown a flow diagram of a method 500 for processing colors in an image having a plurality of pixel values in a first representation, according to an example. The first representation may comprise an RGB color space, a CMY color space, etc.

At step 502, the pixel values of the image to be processed are identified in the first representation. By way of example, the processor 304 may implement or execute the image input value module 310 to identify the pixel values of the image. The image input value module 310 may identify the pixel values through implementation of any reasonably suitable technique for identifying the pixel values. Thus, following step 502, the values of the pixels are identified for the first representation, such as, the values of the pixels in a RGB color space.

At step 504, the pixel values are processed from the first representation to a second representation by converting the pixel values to a more opponent color encoding using a logical operator to compute the yellowness-blueness of the pixel values and using scaled multiplications to compute the redness-greenness of the pixel values in the second representation. An example of a result of the processing operation performed at step 504 is depicted in FIG. 4, as described above.

At step 506, the processed pixel values are outputted to one or more of a display, a memory, a computing device, a printer, etc.

Figure 6:
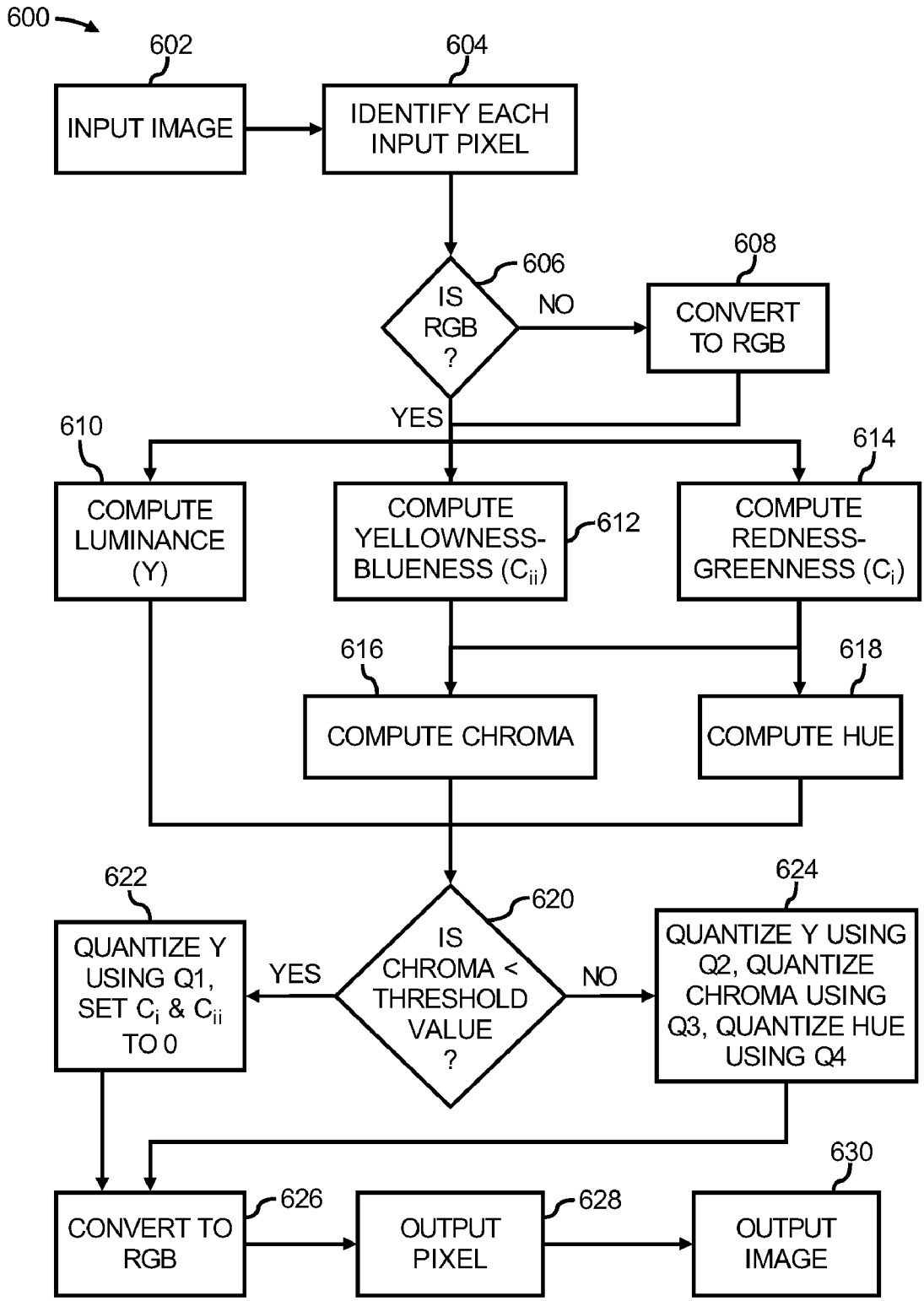
FIG. 6 shows a flow diagram of a method for processing colors in an image having a plurality of pixel values in a first representation, where the method is depicted in greater detail as compared with the method depicted in FIG. 5.

With particular reference now to FIG. 6, there is shown a flow diagram of a method 600 for processing colors in an image having a plurality of pixel values in a first representation, according to an example. The method 600 depicted in FIG. 6 is similar to the method 500 depicted in FIG. 5. However, the method 600 provides a more detailed description of the steps that may be performed in processing the colors as compared with the method 500.

At step 602, an input image to be processed is identified. The input image may be identified, for instance, through receipt of a user command to process the input image. In addition, at step 604, the values of each pixel contained in the input image are identified. The pixel values may be identified in any of a number of conventional manners.

At step 606, a determination as to whether the pixel values are in the RGB color space is made. If it is determined that the pixel values are in a different color space, such as, the CMY color space, the pixel values are converted to the RGB color space as indicated at step 608.

Following either of steps 606 and 608, the luminance (Y), the yellowness-blueness ($C_{ii}$), and the redness-greenness ($C_i$) for each of the pixel values are computed at steps 610-614, respectively. More particularly, steps 610-614 are performed to convert the pixel values from the first representation to a second representation ($YC_iC_{ii}$) and may be performed substantially concurrently. Examples of manners in which these values are computed are provided below. In the following examples, "R" represents the values of the red component, "G" represents the value of the green component, and "B" represents the value of the blue component in the pixel values. In addition, "cn" represents various constant values that may be used in computing the values in the second representation and may thus comprise scalars for the different RGB values. The constant values may each differ from each other or one or more of the constant values may be equal to the same values. In one instance, the constant values for a particular equation may each be equal to one.

At step 610, the luminance (Y) of the pixel values may be computed through the following equation:

$$Y=(c_1*R)+(c_2*G)+(c_3*B). \quad \text{Equation (1):}$$

At step 612, the yellowness-blueness ($C_{ii}$) of the pixel values may be computed through the following equation:

$$C_{ii}=\min(c_4*R \text{ or } c_5*G)-c_6*B. \quad \text{Equation (2):}$$

In Equation (2), the "min" is a minimum function and the minimum of $c_4$*R or $c_5$*G is subtracted from $c_6$*B to compute the yellowness-blueness ($C_{ii}$) of the pixel values.

At step 614, the redness-greenness ($C_i$) of the pixel values may be computed through the following equation:

$$C_i=(c_7*R)-(c_8*G)\pm(c_9*B). \quad \text{Equation (3):}$$

At step 616, the chroma of the pixel values is computed through, for instance, the following equation:

$$\text{chroma}=\text{sqrt}(C_i^2+C_{ii}^2). \quad \text{Equation (4):}$$

At step 618, the hue of the pixel values is computed through, for instance, the following equation:

$$\text{hue}=a\tan(C_i/C_{ii}). \quad \text{Equation (5):}$$

At step 620, a determination as to whether the chroma is less than a predetermined threshold value may be made. The predetermined threshold value may be selected according to any number of factors, such as, desired luminance of colors having less than the predetermined threshold value. By way of particular example, the predetermined threshold may have a value of about between two (2) and ten (10). If it is determined that the chroma is less than the threshold value at step 620, the luminance value (Y) is quantized to a specific number of levels using a quantization process (Q1), with the $C_i$ and $C_{ii}$ values set to zero (0), as indicated at step 622. The specific number of levels may depend upon the specific application of the method 600 and may thus vary according to the application. By setting the $C_i$ and $C_{ii}$ values to zero, the $C_i$ and $C_{ii}$ values are made to have shades of gray.

If it is determined that the chroma is greater than the threshold value at step 620, the luminance value (Y) is quantized to a specified number of levels using a quantization process (Q2), the chroma is quantized to a specified number of levels using a quantization process (Q3), and the hue is quantized to a specified number of levels using a quantization process (Q4), as indicated at step 624. Again, the specific number of quantization levels may depend upon the specific application and may thus vary according to the application being implemented. For instance, the specific number of levels may be selected for the different quantizations to provide a good visual trade-off between color abstraction and color smoothness. By way of a particular example, the specified number of levels for Q2 may be 5, for Q3 may be 5, and for Q4 may be 24.

Following either of steps 622 and 624, one or more of the luminance (Y), chroma, and hue values for the pixel may be converted back to the RGB color space at step 626. In addition, at step 628, the pixel may be outputted to be displayed, for instance. Steps 606-628 may be repeated for the remaining pixels that have been identified at step 604. Moreover, at step 630, an image containing the pixels that have been processed through implementation of the method 600 may be outputted to one or more output devices 330.

Figure 7:
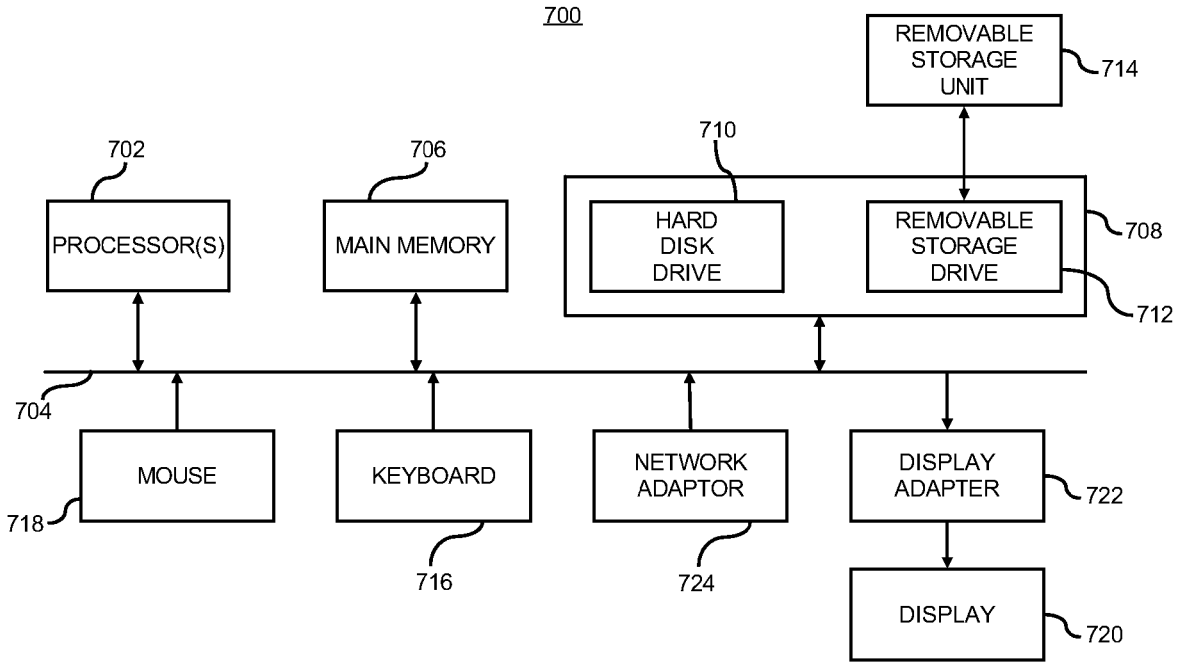
FIG. 7 depicts a block diagram of a computing apparatus configured to implement or execute the processing module depicted in FIG. 3, according to an embodiment of the invention.

Turning now to FIG. 7, there is shown a block diagram of a computing apparatus 700 configured to implement or execute the processing module 312 depicted in FIG. 3, according to an example. In this respect, the computing apparatus 700 may be used as a platform for executing one or more of the functions described hereinabove with respect to the processing module 312.

The computing apparatus 700 includes a processor 702 that may implement or execute some or all of the steps described in the methods 500 and 600. Commands and data from the processor 702 are communicated over a communication bus 704. The computing apparatus 700 also includes a main memory 706, such as a random access memory (RAM), where the program code for the processor 702, may be executed during runtime, and a secondary memory 708. The secondary memory 708 includes, for example, one or more hard disk drives 710 and/or a removable storage drive 712, representing a floppy diskette drive, a magnetic tape drive, a compact disk drive, etc., where a copy of the program code for the methods 500 and 600 or the processing module 312 may be stored.

The removable storage drive 710 reads from and/or writes to a removable storage unit 714 in a well-known manner. User input and output devices may include a keyboard 716, a mouse 718, and a display 720. A display adaptor 722 may interface with the communication bus 704 and the display 720 and may receive display data from the processor 702 and convert the display data into display commands for the display 720. In addition, the processor(s) 402 may communicate over a network, for instance, the Internet, LAN, etc., through a network adaptor 724.

It will be apparent to one of ordinary skill in the art that other known electronic components may be added or substituted in the computing apparatus 700. It should also be apparent that one or more of the components depicted in FIG. 7 may be optional (for instance, user input devices, secondary memory, etc.).

What has been described and illustrated herein is a preferred embodiment of the invention along with some of its variations. The terms, descriptions and figures used herein are set forth by way of illustration only and are not meant as limitations. Those skilled in the art will recognize that many variations are possible within the scope of the invention, which is intended to be defined by the following claims—and their equivalents—in which all terms are meant in their broadest reasonable sense unless otherwise indicated.

What is claimed is:

1. A method for processing pixel values of a color image, said method comprising:

converting, by a processor, the pixel values from a first representation to a second representation, said second representation having a yellow-blue axis, a red-green axis, and a luminance axis, and wherein converting the pixel values further comprises converting the pixel values to a more opponent color encoding using a logical operator to compute a yellowness-blueness value of each of the pixel values and using scaled multiplications to compute a redness-greenness value of each of the pixel values in the second representation; and wherein each of the pixel values comprises a red component (R), a green component (G), and a blue component (B), and wherein converting the pixel values further comprises computing the yellowness-blueness values ($C_{ii}$) of each of the pixel values through the following equation:

$$C_{ii}=\min(c_4*R \text{ or } c_5*G)-c_6*B, \text{ wherein } c_4, c_5, \text{ and } c_6 \text{ are constants.}$$

2. The method according to claim 1, wherein $c_4$, $c_5$, and $c_6$ are each equal to one.

3. The method according to claim 1, wherein converting the pixel values further comprises computing luminance (Y) values of each of the pixel values through the following equation:

$$Y=(c_1*R)+(c_2*G)+(c_3*B), \text{ wherein } c_1, c_2, \text{ and } c_3 \text{ are constants.}$$

4. The method according to claim 1, wherein converting the pixel values further comprises computing the redness-greenness values ($C_i$) of each of the pixel values through the following equation:

$$C_i=(c_7*R)-(c_8*G)\pm(c_9*B), \text{ wherein } c_1, c_2, \text{ and } c_3 \text{ are constants.}$$

5. The method according to claim 1, further comprising:

computing a chroma of each of the pixel values from the yellowness-blueness value and the redness-greenness value of each of the pixel values and comparing the computed chroma to a threshold value.

6. The method according to claim 5, further comprising:

computing luminance values of each of the pixel values; and in response to the computed chroma of a pixel value falling below the threshold, quantizing the luminance value while setting the yellowness-blueness value and the redness-greenness value to zero for that pixel value.

7. The method according to claim 1, further comprising:

computing luminance values of each of the pixel values;

computing a hue of each of the pixel values from the yellowness-blueness value and the redness-greenness value of each of the pixel values; and in response to the computed chroma exceeding the threshold value for a pixel value, quantizing the luminance value, the chroma, and the hue of that pixel value.

8. The method according to claim 7, further comprising:

quantizing the luminance value with a first quantization operation;

quantizing the chroma with a second quantization operation; and quantizing the hue with a third quantization operation.

9. The method according to claim 1, further comprising:

converting the converted pixel values to the first representation based upon at least one of a quantized luminance, a quantized chroma, and a quantized hue of the pixel values.

10. The method according to claim 1, wherein converting the pixel values further comprises implementing an extreme color quantization process on the pixel values.

11. The method according to claim 1, further comprising:

determining whether the first representation comprises an RGB color space; and converting the pixel values to the RGB color space representation in response to the first representation comprising a color space different from the RGB color space prior to the step of converting the pixel values from the first representation to the second representation.

12. An apparatus for processing pixel values of a color image, said apparatus comprising:

a processing module to convert the pixel values from a first representation to a second representation, said second representation having a yellow-blue axis, a red-green axis, and a luminance axis, and wherein the processing module is further to convert the pixel values to a more opponent color encoding using a logical operator to compute a yellowness-blueness value of each of the pixel values and to compute a redness-greenness value of each of the pixel values using scaled multiplication in the second representation;

wherein each of the pixel values comprises a red component (R), a green component (G), and a blue component (B), and wherein the processing module is further to compute the yellowness-blueness values ($C_{ii}$) of each of the pixel values through the following equation:

$$C_{ii}=\min(c_4*R \text{ or } c_5*G)-c_6*B, \text{ wherein } c_4, c_5, \text{ and } c_6 \text{ are constants; and}$$

a processor to at least one of implement and execute the processing module.

13. The apparatus according to claim 12, further comprising:

an output device, wherein the processor is to output converted pixel values on the output device.

14. The apparatus according to claim 12, wherein the processing module is further configured to compute a chroma of each of the pixel values from the yellowness-blueness value and the redness-greenness value of each of the pixel values and to compare the computed chroma to a threshold value.

15. The apparatus according to claim 14, wherein the processing module is further to compute luminance values of each of the pixel values, to compute hues of each of the pixel values from the yellowness-blueness value and the redness-greenness value of each of the pixel values, in response to the computed chroma of a pixel value falling below the threshold, to quantize the luminance value while setting the yellowness-blueness value and the redness-greenness value to zero for that pixel value; and in response to the computed chroma exceeding the threshold value for a pixel value, to quantize the luminance value, the chroma, and the hue of that pixel value.

16. A non-transitory computer readable storage medium on which is embedded one or more computer programs, that when executed implement a method for processing pixel values of a color image, said one or more computer programs comprising a set of instructions to:

convert the pixel values from a first representation to a second representation, said second representation having a yellow-blue axis, a red-green axis, and a luminance axis, and wherein converting the pixel values further comprises converting the pixel values to a more opponent color encoding using a logical operator to compute a yellowness-blueness value of each of the pixel values and using scaled multiplications to compute a redness-greenness value of each of the pixel values in the second representation; and wherein each of the pixel values comprises a red component (R), a green component (G), and a blue component (B), and wherein converting the pixel values further comprises computing the yellowness-blueness values ($C_{ii}$) of each of the pixel values through the following equation:

$$C_{ii}=\min(c_4*R \text{ or } c_5*G)-c_6*B, \text{ wherein } c_4, c_5, \text{ and } c_6 \text{ are constants.}$$

17. The non-transitory computer readable storage medium according to claim 16, said one or more computer programs further comprising a set of instructions:

compute luminance values of each of the pixel values;

compute a hue of each of the pixel values from the yellowness-blueness value and the redness-greenness value of each of the pixel values;

compute a chroma of each of the pixel values from the yellowness-blueness value and the redness-greenness value of each of the pixel values and comparing the computed chroma to a threshold value;

in response to the computed chroma of a pixel value falling below the threshold, quantize the luminance value while setting the yellowness-blueness value and the redness-greenness value to zero for that pixel value; and in response to the computed chroma exceeding the threshold value for a pixel value, quantize the luminance value, the chroma, and the hue of that pixel value.

* * * * *

UNITED STATES PATENT AND TRADEMARK OFFICE

CERTIFICATE OF CORRECTION

PATENT NO. : 8,368,716 B2
APPLICATION NO. : 12/240958
DATED : February 5, 2013
INVENTOR(S) : Nathan Moroney It is certified that error appears in the above-identified patent and that said Letters Patent is hereby corrected as shown below:

In the Claims:

In column 9, line 29, in Claim 7, delete “claim 1,” and insert -- claim 5, --, therefor.

Signed and Sealed this
Seventh Day of May, 2013

Teresa Stanek Rea
*Acting Director of the United States Patent and Trademark Office*